US010711327B2

(12) United States Patent
Scherer et al.

(10) Patent No.: US 10,711,327 B2
(45) Date of Patent: Jul. 14, 2020

(54) COMPOSITE MATERIALS, APPARATUSES, AND METHODS

(71) Applicant: Invetal, Inc., Wisconsin Rapids, WI (US)

(72) Inventors: Roger Scherer, Wisconsin Rapids, WI (US); Jack L. McMillin, Roaming Shores, OH (US); Scott Michael Hinojos, Wisconsin Rapids, WI (US)

(73) Assignee: Invetal, Inc., Wisconsin Rapids, WI (US)

( * ) Notice: Subject to any disclaimer, the term of this patent is extended or adjusted under 35 U.S.C. 154(b) by 0 days.

(21) Appl. No.: 16/458,390

(22) Filed: Jul. 1, 2019

(65) Prior Publication Data

US 2020/0071796 A1 Mar. 5, 2020

Related U.S. Application Data

(60) Provisional application No. 62/725,743, filed on Aug. 31, 2018.

(51) Int. Cl.

| | |
|---|---|
| ***C22C 1/10*** | (2006.01) |
| ***B01F 13/00*** | (2006.01) |
| *B01F 3/12* | (2006.01) |

(52) U.S. Cl.

CPC ..... *C22C 1/1036* (2013.01); *B01F 13/0005* (2013.01); *B01F 2003/1278* (2013.01); *B01F 2215/0044* (2013.01); *C22C 2001/1047* (2013.01)

(58) Field of Classification Search

CPC ..... C22C 1/1036

See application file for complete search history.

(56) References Cited

U.S. PATENT DOCUMENTS

2002/0153123 A1* 10/2002 Unal ..... B22D 11/00 164/480

2012/0244033 A1* 9/2012 Shugart ..... C22C 21/02 420/532

OTHER PUBLICATIONS

Isaacs et al., "Nanocarbon-Copper Thin Film as Transparent Electrode," Applied Physics Letters, 2015, 106:193108-1.

Jaim et al., "Characterization of Carbon Nanostructures in Al and Ag Covetic Alloys," Carbon, 2017, 111:309-321.

Jaim et al., "Sp2 Carbon Embedded in Al-6061 and Al-7075 Alloys in the Form of Crystalline Graphene Nanoribbons," Carbon, 107, 2016, pp. 56-66.

Salamanca-Riba et al., "Synthetic Crystals of Silver with Carbon: 3D Epitaxy of Carbon Nanostructures in the Silver Lattice," Adv. Funct. Mater., 2015, 25:4768-4777.

* cited by examiner

*Primary Examiner* — Scott R Kastler

(74) *Attorney, Agent, or Firm* — Eversheds Sutherland (US) LLP

(57) ABSTRACT

Provided are composite materials that may include a monophasic blend including at least one metal, and graphene. The graphene may be present in the monophasic blend at an amount of about 0.001% to about 90%, by weight, based on the weight of the composite material. Also provided are methods for continuously producing composite materials, and apparatuses.

20 Claims, 4 Drawing Sheets

COMPOSITE MATERIALS, APPARATUSES, AND METHODS

CROSS-REFERENCE TO RELATED APPLICATIONS

This application claims priority to U.S. Provisional Patent Application No. 62/725,743, filed Aug. 31, 2018, which is incorporated herein by reference.

BACKGROUND

Aluminum is a metal that may have several desirable properties; for example, aluminum can be a soft, durable, lightweight, ductile, and/or malleable metal. Aluminum also typically is non-magnetic and non-sparking, but aluminum powder can be highly explosive when introduced to water, and, therefore, may be used as rocket fuel. Aluminum also is generally insoluble in alcohol, though it can be soluble in water in certain forms. Aluminum also has a density that is about one-third the density of steel. Aluminum also is generally corrosion resistant, due at least in part to the thin surface layer of aluminum oxide that may form when exposed to air, which effectively reduces or prevents further oxidation. Aluminum composites, however, are known to suffer from corrosion due to galvanic reaction(s) between dissimilar materials.

A number of metal-carbon materials have been made by various processes. The processes, however, typically are batch processes. The batch processes generally may not be adjusted during operation to tune or impart one or more properties to the resulting metal-carbon material. Moreover, the batch processes are typically incapable of producing metal-carbon materials that are consistent from batch-to-batch. The metal-carbon materials produced by batch processes, therefore, may have one or more properties that can be improved.

There remains a need for methods of producing metal-carbon materials having one or more improved properties, including methods of continuously producing metal-carbon materials. The one or more improved properties of the metal-carbon materials may include improved electrical conductivity, improved thermal conductivity, at least one improved mechanical property, or a combination thereof. There also remains a need for producing metal-carbon materials that take advantage of one or more of the properties of aluminum.

BRIEF SUMMARY

Provided herein are composite materials, apparatuses, and methods that address one or more of the foregoing needs. For example, provided herein are methods of continuously producing composite materials that include a monophasic blend of a metal and a carbon material.

In one aspect, composite materials are provided. In some embodiments, the composite materials include a monophasic blend including (i) at least one metal, and (ii) graphene; wherein the graphene is present in the monophasic blend at an amount of about 0.001% to about 90%, by weight, based on the weight of the composite material.

In another aspect, methods for continuously producing composite materials are provided. In some embodiments, the methods include providing a reservoir including a first feed and a second feed; disposing a liquid metal and a carbon material in the reservoir via the first feed and the second feed, respectively; mixing the liquid metal and the carbon material in a first portion of the reservoir to form a mixture; transporting the mixture from the first portion of the reservoir to a second portion of the reservoir; applying an electrical charge to the mixture in the second portion of the reservoir to form a composite material; and collecting the composite material.

In yet another aspect, apparatuses for continuously producing composite materials are provided. In some embodiments, the apparatuses include a first feed for disposing a liquid metal in a reservoir; a second feed for disposing a carbon material in the reservoir; a device for applying an electrical charge to the liquid metal and the carbon material in the reservoir; and a mixer disposed in the reservoir.

DETAILED DESCRIPTION

Figure 1:
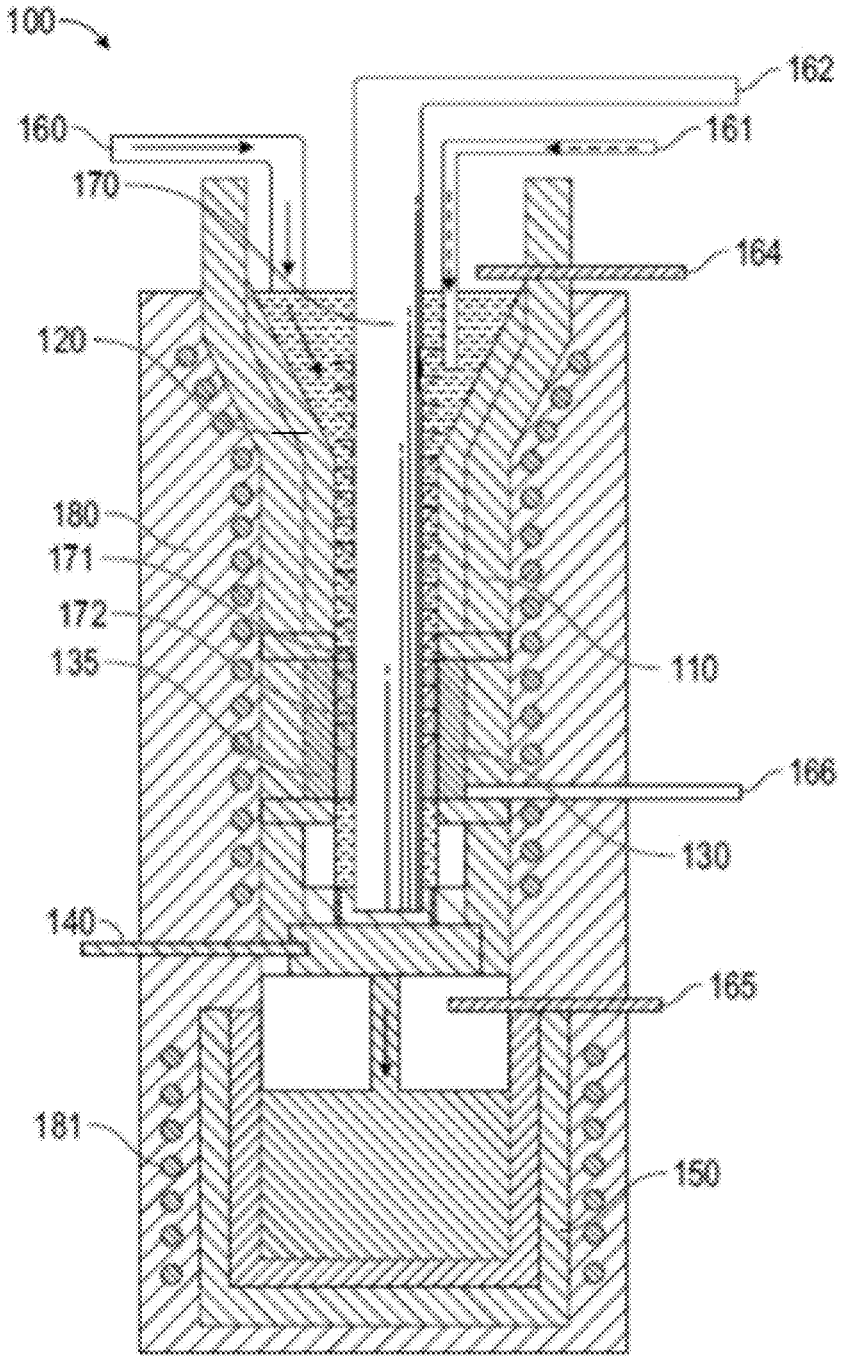
FIG. 1 is a cross-sectional view of an embodiment of an apparatus.

Provided herein are composite materials, methods for continuously producing composite materials, and apparatuses for continuously producing composite materials.

Composite Materials

In one aspect, composite materials are provided. In some embodiments, the composite materials include a monophasic blend including (i) at least one metal, and (ii) graphene. The graphene may be present in the monophasic blend at an amount of about 0.001% to about 90%, or about 1% to about 10%, by weight, based on the weight of the composite material.

The phrase "monophasic blend", as used herein, generally refers to a blend including at least one metal and a carbon material, such as graphene, wherein one or more interactions between the at least one metal and the carbon material prevent the at least one metal and the carbon material from separating from the monophasic blend when the monophasic blend is heated to a temperature that exceeds the melting point of the at least one metal or the monophasic blend. The "one or more interactions" may be imparted upon formation of the monophasic blend, and may include at least one attractive force of any kind, such as a covalent bond, ionic bond, a van der Waals force, a combination thereof, etc.

The graphene may be present in the monophasic blend at an amount of about 0.001% to about 90%, about 0.03% to about 90%, about 0.4% to about 90%, about 5% to about 90%, about 6% to about 90%, about 1% to about 10%, about 2% to about 10%, about 3% to about 10%, about 4% to about 10%, about 5% to about 10%, or about 6% to about 10%, by weight, based on the weight of the composite material.

In some embodiments, the at least one metal is selected from the group consisting of copper, silver, aluminum, lead, zinc, tin, silicon, iron, gold, and a combination thereof.

In some embodiments, the at least one metal includes aluminum. The aluminum may include a 1000 series aluminum (e.g., aluminum 1350), a 2000 series aluminum, a 3000 series aluminum, a 4000 series aluminum, a 5000 series aluminum, a 6000 series aluminum (e.g., aluminum 6005), a 7000 series aluminum, an 8000 series aluminum, or a combination thereof. The aluminum may be selected from the group consisting of a 6000 series aluminum, a 1000 series aluminum, or a combination thereof. The aluminum may be selected from the group consisting of aluminum 6005, aluminum 1350, and a combination thereof.

In some embodiments, the composite material also includes a carbon powder. The carbon powder may include carbon particles having an average diameter of about 0.001 μm to about 200 μm, or about 1 μm to about 200 μm. In some embodiments, the carbon powder has a size that will pass through a 325 mesh.

In some embodiments, the composite material also includes alumina. The alumina may include alumina particles having an average diameter of about 0.001 μm to about 200 μm, or about 1 μm to about 200 μm. In some embodiments, the alumina particles have a size that will pass through a 325 mesh.

In some embodiments, the composite material also includes a piezo electric compound. The piezo electric compound may include piezo electric compound particles having an average diameter of about 0.001 μm to about 200 μm, or about 1 μm to about 200 μm. In some embodiments, the piezo electric compound particles have a size that will pass through a 325 mesh.

As used herein, the phrase "average diameter" is not intended to convey that the particles are necessarily spherical or substantially spherical. The phrase "average diameter", as used herein, is intended to relate to the average largest dimension of the particles. When the particles are spherical or substantially spherical, the phrase relates to the diameter. When the particles are flake shaped, the phrase relates to the largest dimension across the face of the flake.

Apparatuses

Apparatuses for continuously producing a composite material are provided herein. In some embodiments, the apparatuses include a reservoir; a first feed for providing a liquid metal to the reservoir; a second feed for providing a carbon material to the reservoir; a device for applying an electrical charge to the liquid metal and the carbon material in the reservoir; and a mixer disposed in the reservoir.

The apparatuses also may include a third feed for providing either a positive or negative connection to the apparatus. The third feed, in some embodiments, imparts to charge to a mixer.

The reservoir may be heated. In some embodiments, the reservoir is an induction heated reservoir. A temperature inside the reservoir may exceed the melting point of the liquid metal, the composite material, or both the liquid metal and the composite material. The temperature may be maintained throughout a continuous process. The apparatuses may include a cooling coil, which circumvents a reservoir. A cooling coil "circumvents a reservoir" when the cooling coil encircles a reservoir at least once. A cooling coil may encircle a reservoir multiple times. Any liquid (e.g., water) may be disposed in and/or flow through the cooling coil.

The apparatuses also may include a fourth feed for providing an inert gas to the reservoir. Any inert gas, such as argon, may be disposed in the reservoir. The inert gas may prevent or reduce the likelihood of oxygen entering a reservoir. In some embodiments, the inert gas forms a "blanket" at the top of a reservoir, thereby preventing or reducing the likelihood of oxygen entering the reservoir.

The mixer disposed in the reservoir, in some embodiments, is a rotating auger. The mixer, such as the rotating auger, may traverse a first portion of a reservoir in which the contents of the reservoir are mixed. In some embodiments, the mixer, such as the rotating auger, at least partially traverses [1] a first portion of the reservoir in which the contents of the reservoir are mixed, and [2] a second portion of the reservoir in which the device applies an electrical charge to the contents of the reservoir. In some embodiments, the mixer, such as a rotating auger, creates a uniform mixture of the contents of the reservoir. In some embodiments, the mixer, such as a rotating auger, at least assists with transporting the contents within the reservoir, out of the reservoir, or a combination thereof.

In some embodiments, the device for applying an electrical charge to the liquid metal and the carbon material is arranged in a second portion of the reservoir. In some embodiments, the device features an opening through which the contents of a reservoir may pass. In other words, the device defines a void through which the contents of a reservoir may pass. The void, in some embodiments, is circular. A mixer may pass through at least a portion of the void. The device may have a first charge that is provided by a fifth feed, and the mixer may have a second charge that is provided by a third feed. The first charge and the second charge may be opposite charges. For example, the first charge may be negative and the second charge may be positive, or vice versa. The third feed and/or the fifth feed may provide an alternating current or a direct current. The amperage, voltage, or a combination thereof may be adjusted to achieve a desirable result (e.g., product property). It should be noted that the feeds herein are arbitrarily referred to as the first, second, third, fourth, fifth, and sixth feeds; and an apparatus may include any combination of these feeds. Therefore, for example, the presence of a sixth feed in an embodiment should not be construed as implying or necessitating the presence of a feed referred to by a lower number (e.g., a third feed).

In some embodiments, the apparatuses include a holding tank. The holding tank may collect a composite material. The holding tank may be heated. In some embodiments, the holding tank is an induction heated holding tank. A temperature inside the holding tank may exceed the melting point of the composite material. The phrase "melting point of the composite material", as used herein, refers to a temperature at which the composite material becomes molten, and not necessarily a temperature at which each component of the composite material is melted. The temperature may be maintained throughout a continuous process. The apparatuses may include a cooling coil, which circumvents a holding tank. A cooling coil "circumvents a holding tank" when the cooling coil encircles a holding tank at least once. A cooling coil may encircle a holding tank multiple times. Any liquid (e.g., water) may be disposed in and/or flow through the cooling coil. In some embodiments, the apparatuses include a single cooling coil that circumvents the reservoir and the holding tank. In some embodiments, the apparatuses include two or more cooling coils, at least one of which encircles the reservoir, and at least one of which encircles the holding tank. The holding tank, in some embodiments, includes a noble gas, an inert gas, or a combination thereof (e.g., argon, krypton, etc.).

In some embodiments, the apparatuses include a valve, such as a control valve. The control valve may be arranged in a manner that permits the collection of a sample of the composite material. In some embodiments, the control valve is arranged between a reservoir and a holding tank. The valve may be configured to permit a sample to be withdrawn for testing, which may determine whether [1] a continuous process being run in the apparatus is performing in a desirable manner, and/or [2] the composite material has one or more desired properties.

An embodiment of an apparatus for continuously producing a composite material is provided at FIG. 1, which is a cross-sectional depiction of the embodiment. The apparatus 100 includes an induction heated reservoir 110 having a first portion 120 and a second portion 130. A rotating auger 170 is arranged in the center of the reservoir 110, and traverses the first portion 120 and the second portion 130 of the reservoir 110. The rotating auger 170 includes threading 171 that extends from a shaft 172. The second portion 130 of the reservoir 110 hosts an electrical device 135, through which the rotating auger 170 passes. The apparatus 100 also includes a control valve 140 arranged between the second portion 130 of the reservoir 110 and an induction heated holding tank 150. The induction heated holding tank 150 includes an inert gas 165 (e.g., argon). The apparatus 100 includes [1] a first feed 160 for disposing a liquid metal into the first portion 120 of the reservoir 110, [2] a second feed 161 for disposing a carbon material into the first portion 120 of the reservoir 110, [3] a third feed 162 for providing a positive [or negative] electrical connection to the rotating auger 170, [4] a fourth feed 164 for disposing an inert gas (e.g., argon) into the first portion 120 of the reservoir 110, and [5] a fifth feed 166 for providing a negative [or positive] electrical connection to the electrical device 135. The electrical device 135 may be negatively [or positively] charged by the fifth feed 166, while the rotating auger 170, which passes through a void defined by the electrical device 135, is positively [or negatively] charged via the third feed 162. The apparatus 100 also includes a first heating coil 180 that circumvents the reservoir 110, and a second heating coil 181 that circumvents the holding tank 150.

In the embodiment depicted at FIG. 1, the electrical device 135 has a height (i.e., a vertical dimension as depicted at FIG. 1) of about 6 inches. In some embodiments, the height of the electrical device is about 2 inches to about 12 inches, about 2 inches to about 10 inches, or about 2 inches to about 8 inches. Other sizes are envisioned, however. The electrical device generally may have any dimensions (e.g., height) that is suitable for performing the methods provided herein.

In the embodiment depicted at FIG. 1, the threading of the rotating auger 170 terminates about 2 inches above the bottom of the electrical device 135. Therefore, the threading of the rotating auger 170 of FIG. 1 corresponds to about 66% of the height of the electrical device 135. In some embodiments, the portion of a rotating auger that passes through a void defined by an electrical device has threading that corresponds to about 10% to about 100%, about 10% to about 90%, about 10% to about 80%, about 20% to about 80%, about 40% to about 80%, about 60% to about 70%, or about 66% of the electrical device's height (i.e., the vertical dimension depicted at FIG. 1).

In the embodiment depicted at FIG. 1, the distance between the shaft 172 of the rotating auger 170 and the electrical device 135 is about 1 inch. In other embodiments, the distance between a mixer, such as the shaft of a rotating auger, and an electrical device is about 1 inch to about 1.5 inches. In some embodiments, the distance between a mixer, such as the shaft of a rotating auger, and an electrical device is about 1 inch to about 4 feet. In some embodiments, the distance between a mixer, such as the shaft of a rotating auger, and an electrical device is about 1 inch to about 3 feet. In some embodiments, the distance between a mixer, such as the shaft of a rotating auger, and an electrical device is about 1 inch to about 2 feet. In some embodiments, the distance between a mixer, such as the shaft of a rotating auger, and an electrical device is about 1 inch to about 1 foot. The components of a composite material and a composite material may pass through the gap between an electrical device and a mixer.

Methods

Provided herein are methods for continuously producing composite materials. In some embodiments, the methods include providing a reservoir comprising a first feed and a second feed; disposing a liquid metal and a carbon material in the reservoir via the first feed and the second feed, respectively; mixing the liquid metal and the carbon material in a first portion of the reservoir to form a mixture; transporting the mixture from the first portion of the reservoir to a second portion of the reservoir; applying an electrical charge to the mixture in the second portion of the reservoir to form a composite material; and collecting the composite material.

During at least a portion of the methods provided herein, a temperature inside the reservoir exceeds the melting point of the liquid metal, the composite material, or both the liquid metal and the composite material. The temperature inside the reservoir may be static, or it may fluctuate. The temperature inside the first portion of the reservoir and the second portion of the reservoir may be the same or different, and both temperatures may exceed the melting point of the composite material, the liquid metal, or both the composite material and the liquid metal.

In some embodiments, the temperature inside the first portion of the reservoir, the second portion of the reservoir, or both the first and the second portion of the reservoir is about 1000° F. to about 3,300° F. In some embodiments, the temperature inside the first portion of the reservoir, the second portion of the reservoir, or both the first and the second portion of the reservoir is about 1100° F. to about 3300° F. In some embodiments, the temperature inside the first portion of the reservoir, the second portion of the reservoir, or both the first and the second portion of the reservoir is about 1,350° F. to about 3,000° F. In some embodiments, the temperature inside the first portion of the reservoir, the second portion of the reservoir, or both the first and the second portion of the reservoir is about 1,350° F. to about 2,500° F. In some embodiments, the temperature inside the first portion of the reservoir, the second portion of the reservoir, or both the first and the second portion of the reservoir is about 1,350° F. to about 1,750° F. In some embodiments, the temperature inside the first portion of the reservoir, the second portion of the reservoir, or both the first and the second portion of the reservoir is about 1,400° F. to about 1,600° F. In some embodiments, the temperature inside the first portion of the reservoir, the second portion of the reservoir, or both the first and the second portion of the reservoir is about 1,500° F.

In some embodiments, the mixing of the liquid metal and the carbon material includes contacting the liquid metal and the carbon material with a mixer. The mixer, in some embodiments, includes a rotating auger. The mixer is arranged in at least the first portion of the reservoir, and, as explained herein, may also be arranged in the second portion of the reservoir.

The mixer may be operated at any speed effective to sufficiently mix the components. In some embodiments, the rate of mixing is about 30 rpm to about 200 rpm, about 45 rpm to about 180 rpm, about 75 rpm to about 150 rpm, or about 100 rpm to about 150 rpm.

In some embodiments, the mixer is a rotating auger, and one or more of the strip width, outer diameter of the shaft, and pitch may be selected to achieve the mixing of the components of the composite materials described herein.

In some embodiments, the transporting of the mixture from the first portion of the reservoir to the second portion of the reservoir is achieved by gravity, a force applied to the mixture by a mixer, or a combination thereof.

In some embodiments, the applying of the electrical charge to the mixture includes passing the mixture through a void defined by a device that is (i) disposed in the second portion of the reservoir, and (ii) provided a first charge by a feed. A mixer may traverse, i.e., pass through, at least a portion of the void, and the mixer may have a second charge provided by different feed, wherein the first charge and the second charge are opposite charges. The void defined by the device may be circular, but other shapes are envisioned, including polygonal and non-polygonal shapes.

In some embodiments, the applying of the electrical charge includes applying an electrical current to the mixture. The electrical current can be selected from AC, DC, AC/DC half wave, full wave, square wave, filtered wave, or pulsed wave. The electrical current generally may be applied by any suitable electrical conductors, such as a charged mixer, such as a charged rotating auger, and the electrical device. The electrical device may provide a charge that is opposite the charge provided by a mixer, such as a rotating auger. The electrical current generally may have any suitable amperage. In some embodiments, the electrical current used in the methods herein is about 50 amps to about 1,250 amps, about 50 amps to about 1,000 amps, about 90 amps to about 1,000 amps, about 90 amps to about 750 amps, about 90 amps to about 500 amps, about 90 amps to about 400 amps, about 200 amps to about 400 amps, or about 300 amps.

In some embodiments, the applying of the electrical charge includes applying an electrical current to the mixture for a time effective to form a composite material. In some embodiments, the electrical current is applied for about 1 nanosecond to about 5 hours. The electrical current generally may have a frequency, current rate, and/or form that is effective to form a composite material. One or more of the frequency, current rate, and/or form may be modified while the electrical current is applied to the mixture. In some embodiments, the frequency, current rate, and/or form remains substantially unchanged while the electrical current is applied to the mixture.

In some embodiments, the electrical current is pulsed, i.e., the current is alternately applied and removed one or more times. For example, the electrical current may be applied for about 30 seconds to about two minutes, and then removed or turned off for about 30 second to about two minutes, and this cycle may be repeated one or more times. In some embodiments, the electrical current is applied for about 1 minute, and then removed or turned off for about 1 minute, and this cycle is repeated one or more times. In some embodiments, the electrical current used in the methods herein is about 50 amps to about 1,250 amps, about 50 amps to about 1,000 amps, about 90 amps to about 1,000 amps, about 90 amps to about 750 amps, about 90 amps to about 500 amps, about 90 amps to about 400 amps, about 200 amps to about 400 amps, or about 300 amps, and the electrical current is pulsed for one or more cycles by alternately applying the electrical current for about 30 seconds to about two minutes, and then removing or turning off the electrical current about 30 seconds to two minutes.

In some embodiments, the applying of the electrical charge occurs at a temperature that is greater than the melting point of the mixture, the at least one metal of the mixture, or both the at least one metal and the mixture.

In some embodiments, the collecting of the composite material includes transporting the composite material from the second portion of the reservoir to a holding tank. The transporting of the composite material from the second portion of the reservoir to the holding tank may be achieved by gravity. In some embodiments, the temperature inside the holding tank exceeds the melting point of the composite material, the liquid metal, or both the composite material and the liquid metal. In some embodiments, the holding tank includes an inert gas.

In some embodiments, a control valve is arranged between the second portion of the reservoir and the holding tank, and the method includes removing a sample of the composite material through the control valve.

In some embodiments, the reservoir includes a sixth feed, and the method includes disposing one or more additives in the reservoir via the sixth feed.

In some embodiments, the methods provided herein are performed in an apparatus, such as the apparatus depicted in cross-section at FIG. 1. In some embodiments, the continuous process includes provided an apparatus described herein, such as the apparatus depicted in cross-section at FIG. 1, and activating the apparatus by flowing water through the cooling coils (180, 181), and activating the induction heated reservoir 110 to ensure that a temperature inside the reservoir 110 exceeds the melting point of the liquid metal, the composite material, or a combination thereof. Via the third feed 162, the fourth feed 164, and the fifth feed 166, a positive [or negative] electrical current may be provided to the rotating auger 170, an inert gas, such as argon, may be disposed in the reservoir 110, and a negative [or positive] charge may be provided to the electrical device 135, respectively. After reaching a desirable temperature inside the reservoir 110, the first feed 160 and the second feed 161 may be used, respectively, to dispose a liquid metal and a carbon material into the first portion 120 of the reservoir 110. In the first portion 120 of the reservoir 110, the contents of the reservoir 110 are mixed by the rotating auger 170 to form a mixture. The mixture may be a uniform mixture of the contents of the reservoir. The rotating auger 170 may turn continuously during the continuous process. The mixture is then transported via gravity to the second portion 130 of the reservoir 110, and passes through an opening in the electrical device 135, which has a negative [or positive] charge that is opposite the positive [or negative] charge of the third feed 162 that charges the rotating auger 170. The charge applied by the apparatus may convert the mixture to the composite material; therefore, the mixture may be converted to the composite material in the second portion 130 of the reservoir 110. The composite material then may pass through a control valve 140, which can be opened to take samples of the composite material for quality control or other purposes. The composite material then may pass through a blanket of inert gas 165 before passing into a holding tank 150. The inert gas blanket 165 may remove one or more unwanted gasses from the composite material. The temperature inside the holding tank 150 may permit the composite material to be poured into billets or extruded into a shape, such as a rod, pellet, sheet, film, etc.

In some embodiments, the apparatuses provided herein include a rotating screw inside a stationary shaft. To the liquid metal and carbon material in the shaft, one or more additives may be added via a shaft having multiple helixes to dry and/or heat up the additives. Multiple additives can be added into the same helix shaft, and may be heated to a desired temperature by radiant heat from the molten mixture, an electrical current provided by the shaft (which may act as an electrode), or a combination thereof. The "shaft electrode" may be either positive or negative, and may apply either alternating or direct current. The heated, dried additive(s) may be dispersed at the bottom of the shaft. The shaft itself may be stationary, but the helix may rotate and force additive(s) into the molten melt. The bottom of the rotating shaft may include a small opening in which an additive(s) is dispersed via the rotating shaft and, optionally, a mixing device into the molten material, which includes a liquid metal and a carbon material. The bottom area of the shaft may host the opposite electrode from the shaft, and its location may permit a material to pass through an area having within a desirable distance of both electrodes. Past this point, a material may pass through a gate valve, where sampling may occur. The material then may pass through an inert gas window, and then to a holding tank.

In some embodiments, the methods provided herein permit one or more tons of consistent material to be produced daily. For example, the amount produced on a daily basis could be more than 80 tons, about 1 ton to about 80 tons, or about 1 ton to about 20 tons.

Liquid Metals

In some embodiments, the liquid metal includes aluminum, copper, silver, lead, zinc, tin, silicon, iron, gold, or a combination thereof. In some embodiments, the liquid metal includes aluminum. In some embodiments, the at least one metal includes aluminum. The aluminum may include a 1000 series aluminum (e.g., aluminum 1350), a 2000 series aluminum, a 3000 series aluminum, a 4000 series aluminum, a 5000 series aluminum, a 6000 series aluminum (e.g., aluminum 6005), a 7000 series aluminum, an 8000 series aluminum, or a combination thereof. The aluminum may be selected from the group consisting of aluminum 6005, aluminum 1350, and a combination thereof.

Carbon Materials

In some embodiments, the carbon material used in the methods provided herein includes graphene. The graphene may be in any form, such as a powder, flakes, granules, or a combination thereof. In some embodiments, the use of graphene in the methods provided herein results in a composite material having improved electrical conductivity, improved thermal conductivity, or a combination thereof. Non-limiting examples of graphene that may be used in the methods provided herein include 006 graphene, 008 graphene, or a combination thereof. Graphenes 4119 and 5564, which are available from Asbury Carbons (USA), also may be used individually or in combination. In some embodiments, the graphene has an average particle size of about 10 μm to about 44 μm, or about 10 μm to about 22 μm.

In some embodiments, the carbon material used in the methods provided herein includes carbon powder. There are a variety of commercially available and/or known carbon powders, and the carbon powder used in the methods provided herein may include a single type of carbon powder or a combination of two or more different types of carbon powders. In some embodiments, the carbon powder may alter one or more properties of the composite materials. For example, the carbon powder may improve one or more anti-friction properties of the composite materials, improve the moldability of the composite materials, improve the composite materials' resistance to acids, improve the long term weatherability of the composite materials, improve the anti-tarnish properties of the composite materials, increase the flow rate of the composite materials, reduce breakout pressure, lower processing temperature, increase process rate and output or throughput of the composite materials, or a combination thereof.

Additives

In some embodiments, the one or more additives used in the methods provided herein includes alumina (i.e., aluminum oxide).

In some embodiments, the one or more additives used in the methods provided herein includes boron.

In some embodiments, the one or more additives used in the methods provided herein includes nano composite fluff. Not wishing to be bound by any particular theory, it is believed that nano composite fluff may improve a resulting composite material's electrical conductivity, thermal conductivity, one or more mechanical properties, or a combination thereof.

In some embodiments, the one or more additives used in the methods provided herein includes silicon carbide. In some embodiment, the inclusion of silicon carbide can improve one or more properties of the composite materials.

In some embodiments, the one or more additives used in the methods provided herein include at least one piezo electric compound/element. The piezo electric compound/element may result in a conversion of one or more mechanical characteristics to one or more electrical characteristics.

Any amount of an additive may be included in the composite materials provided herein. In some embodiments, the one or more additives are present in the composite materials at an amount of about 0.001% to about 90%, by weight, based on the weight of the composite material. The amount of an additive may depend on the other components of a composite material, a particular customer's specifications, or a combination thereof.

It is believed that embodiments of the methods described herein allow for the easy addition and/or changing of additives added to a composite material. For example, the continuous processes described herein may permit changes in the type and/or amount of additive(s) to be made without stopping the production line and changing the entire process. The components of a monophasic blend can remain constant, while the type and/or amount of additive(s) may be adjusted with relative ease in order to meet customer end requirements.

Applications

The composite materials described herein and the composite materials made by the methods described herein can have a number of applications. For example, the composite materials could be used in the manufacture of heat shields, including heat shields for lightning strikes, which may appear on the wings of aircraft. The composite materials herein also could be used in an oil-less automobile engine, possibly due to enhanced reduction of friction. The composite materials herein could be used as (or as a component of) electrical wire, and the composite materials herein may be tailored for this application by the addition of one or more select additives.

The composite materials described herein could be used as (or as a component of) body armor, wherein the enhanced added platelets may act as a deflection for shrapnel or ammunition rounds. The composite materials described herein could be used as, or as part of, tank or heavy artillery armor, and the use of the composite materials for these purposes might reduce the weight, speed, and/or distance the heavy armor could travel on limited fuel amounts.

The terms "a," "an," and "the" are intended to include plural alternatives, e.g., at least one. For instance, the disclosure of "a carbon material", "a metal," and the like, is meant to encompass one, or mixtures or combinations of more than one carbon material, metal, and the like, unless otherwise specified.

In the descriptions provided herein, the terms "includes," "is," "containing," "having," and "comprises" are used in an open-ended fashion, and thus should be interpreted to mean "including, but not limited to." When methods or apparatuses are claimed or described in terms of "comprising" various components or steps, the methods or apparatuses can also "consist essentially of" or "consist of" the various components or steps, unless stated otherwise.

Various numerical ranges may be disclosed herein. When Applicant discloses or claims a range of any type, Applicant's intent is to disclose or claim individually each possible number that such a range could reasonably encompass, including end points of the range as well as any sub-ranges and combinations of sub-ranges encompassed therein, unless otherwise specified. Moreover, all numerical end points of ranges disclosed herein are approximate. As a representative example, Applicant discloses, in one embodiment, that graphene may be present in the monophasic blend at an amount of about 1% to about 10%, by weight, based on the weight of the composite material. This range should be interpreted as encompassing weight percentages of about 1% to about 10%, and further encompasses "about" each of 2%, 3%, 4%, 5%, 6%, 7%, 8%, and 9%, including any ranges and sub-ranges between any of these values.

The term "about", as used herein, refers to values that are within 5% of the indicated value.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims.

The present invention is further illustrated by the following examples, which are not to be construed in any way as imposing limitations upon the scope thereof. On the contrary, it is to be clearly understood that resort may be had to various other aspects, embodiments, modifications, and equivalents thereof which, after reading the description herein, may suggest themselves to one of ordinary skill in the art without departing from the spirit of the present invention or the scope of the appended claims. Thus, other aspects of this invention will be apparent to those skilled in the art from consideration of the specification and practice of the invention disclosed herein.

EXAMPLES

Example 1—Preparation and Testing of Samples Including Aluminum 1350

Three samples of composite materials that included aluminum 1350 were prepared and tested, as explained in this example.

The three samples that were tested in this example included the following:

1) 1350-EC (control sample)
2) 1350-B (Aluminum 4%)(no current applied)
3) 1350-3 (Aluminum 4%)

Sample 1 ("1350-EC") was an Al 1350 base aluminum material that was melted in a furnace and raised to a processing temperature before a sample of the material was collected for testing.

Sample 2 ("1350-B") was an Al 1350 base aluminum material that was mixed with graphene (4 wt. %, based on the total weight of the sample), and raised to a temperature of 1,500° F. prior to being collected for testing. Sample 2 was not contacted with an electric current.

Sample 3 ("1350-3") was an Al 1350 base aluminum material that was mixed with graphene (4 wt. %, based on the total weight of the sample), heated to a temperature of 1,500° F., and contacted with a DC current of about 300 amps in the apparatus of FIG. 1. The DC current of this example was pulsed (1 minute on/1 minute off), and applied by electrodes that were about 1 inch apart.

The graphene of Sample 2 and Sample 3 was a synthetic graphene powder (5564, Asbury Carbons, USA).

The analysis of the samples included the following tests: 1) measurement of volume conductivity, 2) thermomechanical analysis to calculate the coefficient of linear thermal expansion (CTE), 3) hardness measurement, 4) scanning electron microscopy and energy dispersive x-ray spectroscopy (SEM/EDS) to verify carbon additions, and 5) tensile and elongation testing.

The testing revealed that the volume conductivity ranged from a minimum of 60.6% IACS for the '1350-B' sample to a maximum of 61.5% IACS for the '1350-EC (control sample)' sample, as shown at the following table. The conductivity results were collected according to the ASTM E1004-17 eddy current method.

| Sample | Sample Volume Conductivity at 20° C. (% IACS) |
|---|---|
| 1350-EC (control sample) | 61.5 |
| 1350-B | 60.6 |
| 1350-3 (covetic Aluminum 4%) | 60.7 |

The coefficients of linear thermal expansion ranged from a minimum of 20.98 μm/(m·° C.) for the '1350-3 (covetic Aluminum 4%)' sample to a maximum of 24.22 μm/(m·° C.) for the '1350-B' sample, as depicted at the following table. The CTE results were collected by thermomechanical analysis according to ASTM E831-14. The heating rate was 5° C./min, a probe force of 0.1 g was used, and a nitrogen purge gas was used for all specimens.

| Sample | Sample Specimen Length (mm) | Midpoint Temperature, T (° C.) | Temperature Range, ΔT (° C.) | CTE (μm/(m · ° C.)) |
|---|---|---|---|---|
| 1350-EC (control sample) | 3.7234 | 99.49 | 99.46 | 23.90 |
| 1350-B | 3.2186 | 100.42 | 100.57 | 24.22 |
| 1350-3 (covetic Aluminum 4%) | 3.3689 | 100.23 | 100.27 | 20.98 |

The samples of this example were too soft for any of the Rockwell hardness scales, so Vickers microhardness was used instead, and the Vickers microhardness results ranged from a minimum of 30.1 HV0.01 for the '1350-B' sample to a maximum of 33.0 HV0.01 for the '1350-3 (covetic Aluminum 4%)' sample, as shown at the following table.

| Sample | Average of five indents. Sample HV 0.01, Mean |
|---|---|
| 1350-EC (control sample) | 30.6 |
| 1350-B | 30.1 |
| 1350-3 (covetic Aluminum 4%) | 33.0 |

The SEM/EDS bulk chemistry results showed that all three samples of this example had a carbon content of about 4.0 wt %, but these results were considered invalid since it was known that the control sample did not contain this much carbon by weight. The SEM/EDS bulk chemistry results are provided at the following table.

| | Weight Percentages (σ) | | | |
|---|---|---|---|---|
| Sample | Al | C | O | Fe |
| 1350-EC (control sample) | 95.4 (0.3) | 4.2 (0.3) | 0.4 (0.1) | — |
| 1350-B | 95.5 (0.3) | 3.9 (0.3) | 0.6 (0.1) | — |
| 1350-3 (covetic Aluminum 4%) | 94.8 (0.3) | 4.3 (0.3) | 0.6 (0.1) | 0.3 (0.1) |

The yield strength ranged from a minimum of 4.0 ksi for the '1350-EC (control sample)' sample to a maximum of 4.8 ksi for the '1350-3 (covetic Aluminum 4%)'. Ultimate tensile strength ranged from a minimum of 8.2 ksi for the '1350-B' sample to a maximum of 8.6 ksi for the '1350-3 (covetic Aluminum 4%)' sample. Elongation in 1" ranged from a minimum of 27.5% for the '1350-3 (covetic Aluminum 4%)' sample to a maximum of 40.4% for the '1350-EC (control sample cast at SCKP)' sample. The tensile and elongation results (ASTM E8) are provided at the following table (average of four tests).

| Sample | Yield Strength (0.2% offset), Mean (ksi) | Ultimate Tensile Strength, Mean (ksi) | Elongation in 1", Mean (%) |
|---|---|---|---|
| 1350-EC (control sample) | 4.0 | 8.4 | 40.4 |
| 1350-B | 4.3 | 8.2 | 30.9 |
| 1350-3 (covetic Aluminum 4%) | 4.8 | 8.6 | 27.5 |

Example 2—Preparation and Testing of Composite Materials

Six samples of composite materials were made and tested in this example using the procedure described for "Sample 3" of Example 1. The samples of this example included 6005 aluminum alloy, 4 wt % of a carbon material, and, optionally, alumina or silicon carbide. The carbon material used for this example included synthetic and normal graphene powder. The "4 wt %" of this example was based on the weight of the composite material.

The following table explains the composition of the six samples of this example:

| Sample No. | Metal | Carbon Material | Additive |
|---|---|---|---|
| 1 | 6005 Aluminum Alloy | Graphene powder (4%) | Alumina (4%) |
| 2 | 6005 Aluminum Alloy | Graphene powder (4%) | Alumina (4%) |
| 3 | 6005 Aluminum Alloy | Graphene powder (4%) | Alumina (2%) |
| 4 | 6005 Aluminum Alloy | Graphene powder (4%) | Silicon Carbide |

-continued

| Sample No. | Metal | Carbon Material | Additive |
|---|---|---|---|
| 5 | 6005 Aluminum Alloy | Graphene powder (4%) | None |
| 6 | 6005 Aluminum Alloy | Graphene powder (4%) | None |

The samples of this example were subjected to the following analyses: [1] measurement of bulk resistivity/conductivity, [2] thermomechanical analysis to calculate the coefficient of linear thermal expansion (CTE), [3] measurement of Rockwell hardness, [4] scanning electron microscopy to evaluate possible carbon addition, and [5] energy dispersive X-ray spectroscopy (SEM/EDS) to evaluate possible carbon addition.

The resistivity and conductivity were measured according to ASTM B193-02, and the results are provided at the following table.

| Sample No. | Sample Volume Resistivity at 20° C. ($\Omega$*mm$^2$/m) | Weight Resistivity at 20° C. ($\Omega$*g/m$^2$) | Volume Conductivity at 20° C. (% IACS) | Weight Conductivity at 20° C. (% IACS) |
|---|---|---|---|---|
| 1 | 0.0374526 | 0.101121904 | 46.03 | 151.58 |
| 2 | 0.0383554 | 0.103559561 | 44.95 | 148.01 |
| 3 | 0.0386731 | 0.104417277 | 44.58 | 146.80 |
| 4 | 0.0379002 | 0.10233058 | 45.49 | 149.79 |
| 5 | 0.0394528 | 0.106522551 | 43.70 | 143.89 |
| 6 | 0.0389738 | 0.105229187 | 44.24 | 145.66 |

The testing of this example revealed that the volume conductivity of the samples of this example ranged from a minimum of 43.70% IACS for Sample 5 to a maximum of 46.03% IACS for Sample 1.

The Coefficient of Linear Thermal Expansion (CTE) was determined by thermomechanical analysis according to ASTM E831-14. A heating rate of 5° C./min, a probe force of 0.1 g, and a nitrogen purge gas was used for all six samples. The CTE results are provided at the following table.

| Sample No. | Sample Specimen Length (mm) | Midpoint Temperature, T (° C.) | Temperature Range, ΔT (° C.) | CTE (μm/(m · ° C.)) |
|---|---|---|---|---|
| 1 | 4.5299 | 99.37 | 100.05 | 24.93 |
| 2 | 4.8497 | 99.42 | 100.24 | 24.09 |
| 3 | 4.2038 | 99.77 | 100.88 | 22.93 |
| 4 | 5.0348 | 100.12 | 100.03 | 23.85 |
| 5 | 5.1370 | 100.08 | 99.66 | 23.77 |
| 6 | 4.8579 | 100.06 | 100.58 | 23.32 |

The testing of this example revealed that the coefficients of linear thermal expansion ranged from a minimum of 22.93 μm/(m·° C.) for Sample 3 to a maximum of 24.93 μm/(m·° C.) for Sample 1.

The testing of this example revealed that the Rockwell hardness (H scale)(HRH) ranged from a minimum of 68.08 HRH for Sample 1 to a maximum of 78.62 HRH for Sample 4. The following table depicts the Rockwell hardness (H scale) results (ASTM E18-16)(average of five indents).

| Sample No. | HRH, Mean |
|---|---|
| 1 | 68.08 |
| 2 | 70.22 |
| 3 | 74.76 |
| 4 | 73.10 |
| 5 | 78.62 |
| 6 | 76.66 |

Also, the SEM/EDS bulk chemistry results were comparable among the samples with a carbon content of −4.0 wt %. The SEM/EDS bulk chemistry results are provided at the following table.

| Sample | Weight Percentages (σ) | | | | | |
|---|---|---|---|---|---|---|
| No. | Al | C | O | Mg | Fe | Si |
| 1 | 94.5 (0.3) | 3.9 (0.3) | 0.5 (0.1) | 0.5 (0.0) | 0.3 (0.1) | 0.3 (0.0) |
| 2 | 94.6 (0.3) | 3.9 (0.3) | 0.5 (0.1) | 0.4 (0.0) | 0.3 (0.0) | 0.3 (0.1) |
| 3 | 94.3 (0.3) | 3.8 (0.3) | 0.6 (0.1) | 0.6 (0.1) | 0.4 (0.0) | 0.3 (0.0) |
| 4 | 94.0 (0.3) | 4.1 (0.3) | 0.6 (0.1) | 0.4 (0.0) | 0.4 (0.1) | 0.4 (0.0) |
| 5 | 93.9 (0.3) | 4.0 (0.3) | 0.7 (0.1) | 0.6 (0.1) | 0.4 (0.0) | 0.3 (0.0) |
| 6 | 94.2 (0.3) | 4.1 (0.3) | 0.6 (0.1) | 0.5 (0.0) | 0.3 (0.0) | 0.3 (0.1) |

Example 3—Analysis of Billets

In this example, extruded rods were subjected to thermo-mechanical processing and analysis. The samples of this example included 6005 aluminum alloy as the metal, and 4%, by weight, graphene as a carbon material.

The samples of this example were made according to the procedures described at Example 1. The samples were extruded into a rod, then a wire, and drawn by the testing service, who performed the tests for which results are provided.

The extrusion of the samples of this example was performed (i) on billets having the following features and (ii) with the following parameters.

| Property | Value |
|---|---|
| Number of Billets | 7<br>Labeled as "A", "B", "C", "5", "6", "7", "8" |
| Billet size | Diameter - about 2 inches<br>Length - about 2 inches |
| Extrusion Die | 0.5 inches in diameter |
| Billet Homogenization Process | 98° F. for 24 hours |
| Billet Preheat Temperature | 800° F. |
| Die Preheat Temperature | 750° F. |
| Extrusion Pressure | About 90 tons |

All of the billets of this example were relatively easy to extrude. Recovered from each billet were two pieces—one short piece and one long piece—as listed at the following table. After extrusion, the materials were air cooled.

| | Extrusion Lengths | |
|---|---|---|
| Billet Sample | Length 1 ("Short" Piece)(inches) | Length 2 ("Long" Piece)(inches) |
| A | 5 | 26.5 |
| B | 5 | 26 |
| C | 5 | 25 |
| 5 | 5 | 25 |

-continued

| | Extrusion Lengths | |
|---|---|---|
| Billet Sample | Length 1 ("Short" Piece)(inches) | Length 2 ("Long" Piece)(inches) |
| 6 | 5 | 17 |
| 7 | 4.5 | 25 |
| 8 | 4 | 26 |

The extruded samples were subjected the following analyses: [1] mechanical processing, including rotary swaging down to 0.230", followed by wire drawing down to a target finished diameter of 0.114", [2] collection of conductivity interval data, [3] collection of tensile and elongation interval data, and [4] optical emission spectroscopy (OES) to verify alloy chemistry.

The rod samples of this example were rotary swaged down to 0.230 inches in diameter, followed by die drawing down to a finished diameter of 0.115 inches. The samples processed easily, and required no intermediate anneal. The following table depicts the complete reduction sequences for the samples. The reduction sequences targeted a finished diameter of 0.114 inches, which is a commonly used wire size.

| Diameter (inches) | Area (inches$^2$) | Reduction from Previous (%) | Total Reduction (%) | Notes |
|---|---|---|---|---|
| 0.500 | 0.1963 | 0.0 | 0.0 | Pre-processing |
| 0.390 | 0.1195 | 39.2 | 39.2 | Rotary Swaged |
| 0.350 | 0.0962 | 19.5 | 51.0 | Rotary Swaged |
| 0.310 | 0.0755 | 21.6 | 61.6 | Rotary Swaged |
| 0.270 | 0.0573 | 24.1 | 70.8 | Rotary Swaged |
| 0.250 | 0.0491 | 14.3 | 75.0 | Rotary Swaged |
| 0.230 | 0.0415 | 15.4 | 78.8 | Rotary Swaged |
| 0.218 | 0.0373 | 10.2 | 81.0 | Die Drawn |
| 0.198 | 0.0308 | 17.5 | 84.3 | Die Drawn |
| 0.175 | 0.0241 | 21.9 | 87.8 | Die Drawn |
| 0.153 | 0.0184 | 23.6 | 90.6 | Die Drawn |
| 0.135 | 0.0143 | 22.1 | 92.7 | Die Drawn |
| 0.115 | 0.0104 | 27.4 | 94.7 | Die Drawn |

Figure 2:
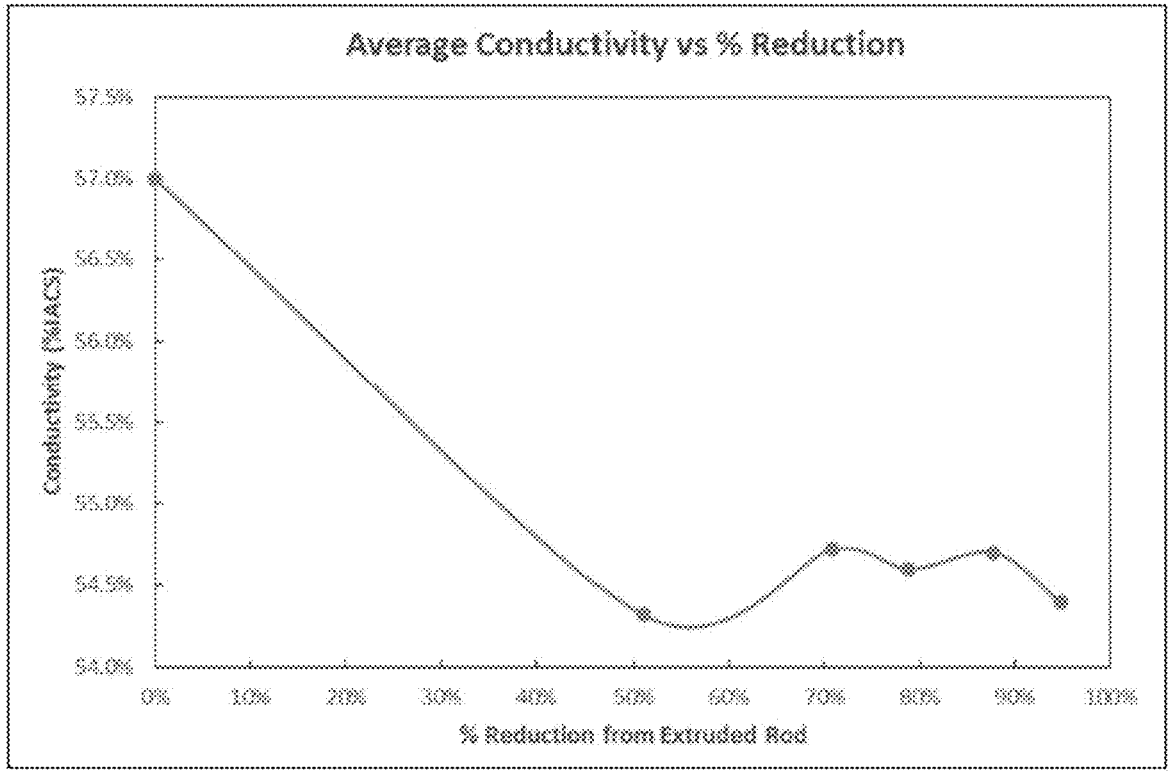
FIG. 2 depicts the average volume conductivity of embodiments of rod samples versus the percent reduction from extruded rods.

The average internal conductivity data is presented at FIG. 2. FIG. 2 depicts a drop in volume conductivity from 57% IACS a 0% reduction to 54.5% IACS at 95% reduction. It should be noted that the small increase in conductivity between 50% and 95% reduction was likely the result of measurement error.

Figure 3:
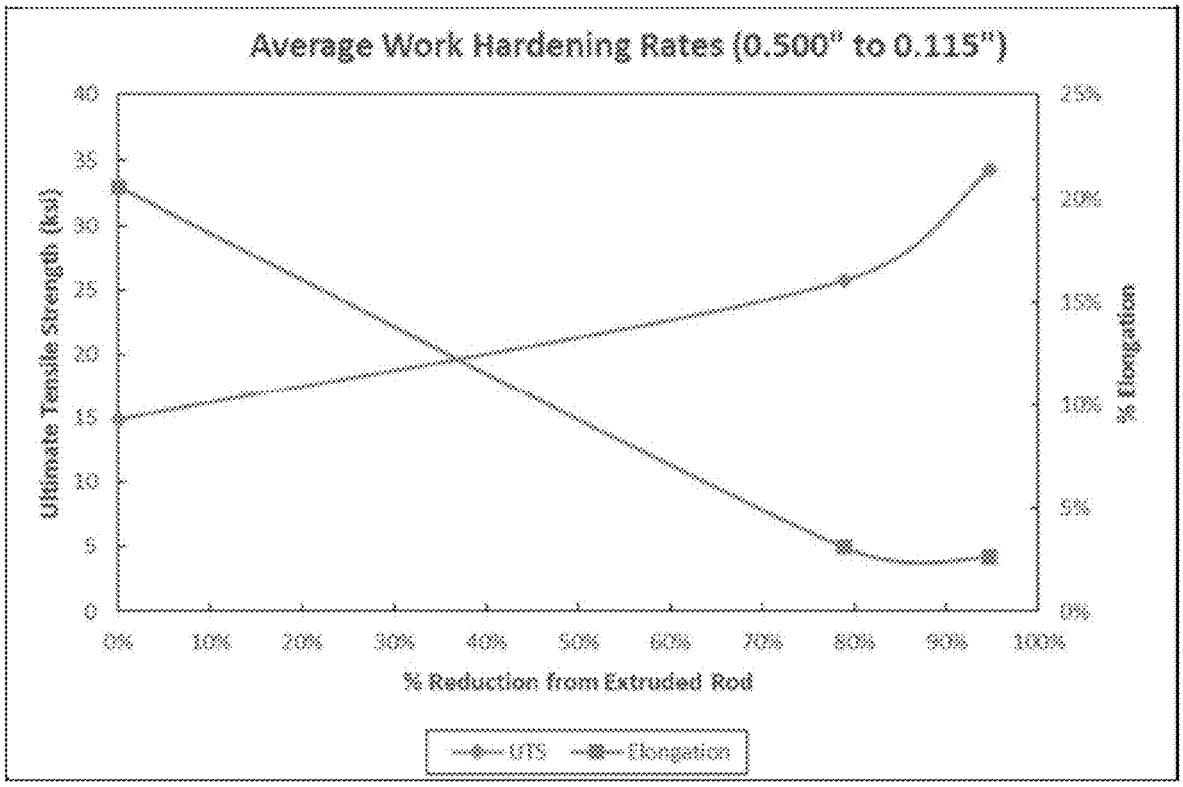
FIG. 3 depicts the average work hardening rates for embodiments of rod samples.

Work hardening curves are depicted at FIG. 3, which shows an increase in ultimate tensile strength from 15 ksi at 0% reduction to 35 ksi at 95% reduction, with an associated decrease in elongation (in 10") from 20% at 0% reduction to 3% at 95% reduction.

The OES chemistry results for the samples of this example are presented at the following table.

| Atom | Sample | | | | | | |
|---|---|---|---|---|---|---|---|
| (%) | A | B | C | 5 | 6 | 7 | 8 |
| Si | 0.641 | 0.638 | 0.636 | 0.735 | 0.690 | 0.729 | 0.734 |
| Fe | 0.419 | 0.427 | 0.414 | 0.271 | 0.251 | 0.273 | 0.269 |
| Cu | 0.081 | 0.079 | 0.078 | 00.049 | 0.046 | 0.048 | 0.049 |
| Mn | 0.045 | 0.043 | 0.042 | 0.041 | 0.041 | 0.041 | 0.041 |
| Mg | 0.099 | 0.082 | 0.079 | 0.094 | 0.088 | 0.095 | 0.096 |
| Cr | 0.017 | 0.016 | 0.015 | 0.012 | 0.013 | 0.013 | 0.013 |
| Zn | 0.073 | 0.046 | 0.043 | 0.022 | 0.021 | 0.022 | 0.022 |
| Ti | 0.011 | 0.011 | 0.011 | 0.010 | 0.010 | 0.015 | 0.016 |

-continued

| Atom (%) | Sample A | B | C | 5 | 6 | 7 | 8 |
|---|---|---|---|---|---|---|---|
| Ti + V + Zr | 0.020 | 0.019 | 0.019 | 0.017 | 0.016 | 0.024 | 0.025 |
| Each % | <0.05 | <0.05 | <0.05 | <0.05 | <0.05 | <0.05 | <0.05 |
| Al % | rem. | rem. | rem. | rem. | rem. | rem. | rem. |

Figure 4:
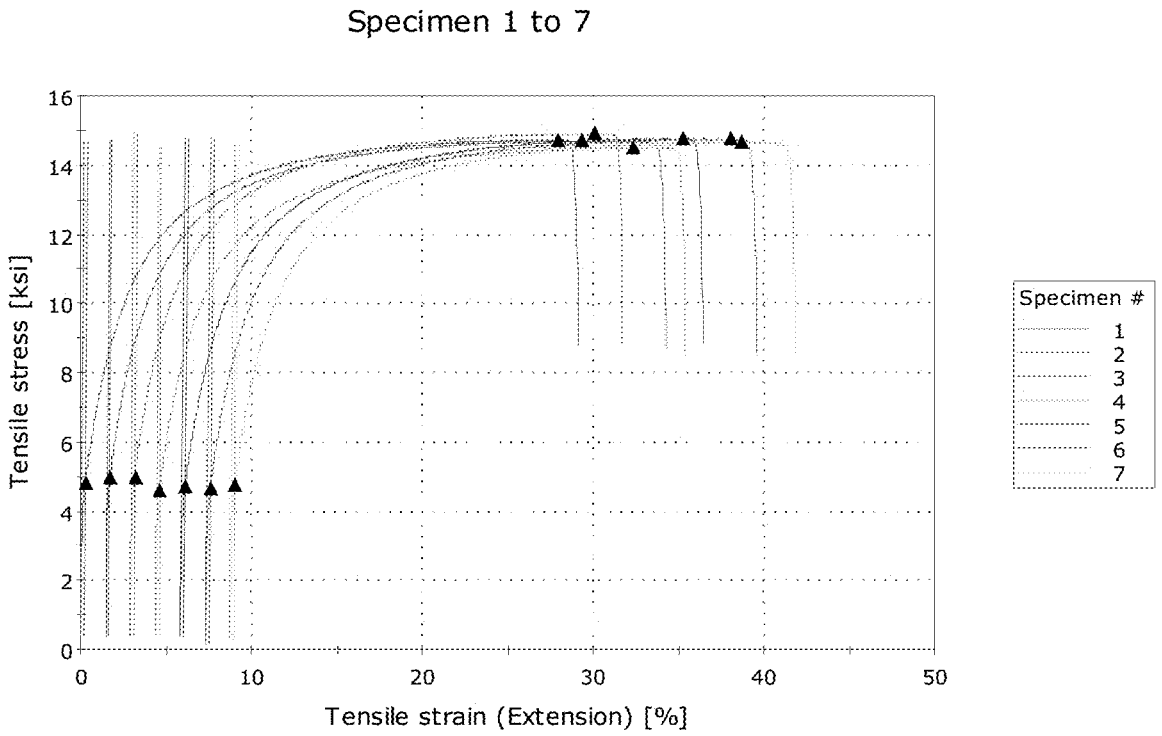
FIG. 4 depicts a plot of tensile strength versus tensile strain for embodiments of extruded and fully annealed rods.

FIG. 4 depicts a plot of tensile stress versus tensile strain for the extruded rods of this example after the rod had been fully annealed at finished size. The following table depicts the properties of the fully annealed samples.

-continued

| Sample | Diameter (inches) | Area (inches$^2$) | Yield Strength (offset = 0.2%) | Ultimate Tensile Strength | Valid Break? | Elongation in 10 in (%) |
|---|---|---|---|---|---|---|
| 6 (fully annealed) | 0.1150 | 0.01039 | 4.7 | 14.8 | Yes | 26.6 |
| 7 (fully annealed) | 0.1150 | 0.01039 | 4.6 | 14.8 | Yes | 28.2 |
| 8 (fully annealed) | 0.1150 | 0.01039 | 4.7 | 14.7 | Yes | 28.8 |
| Mean | 0.1150 | 0.01039 | 4.8 | 14.7 | — | 27.2 |
| Standard Deviation | 0.0000 | 0.00000 | 0.2 | 0.1 | — | 1.4 |

The resistivity and conductivity data (ASTM B193-02) for the samples of this example are provided in the following table.

| Property | Sample A | B | C | 5 | 6 | 7 | 8 |
|---|---|---|---|---|---|---|---|
| Weight (g) | 18.64 | 18.74 | 18.64 | 18.67 | 18.6 | 18.6 | 18.6 |
| Length (m) | 1.022 | 1.025 | 1.02 | 1.023 | 1.018 | 1.018 | 1.019 |
| Temperature (° C.) | 20.4 | 20.4 | 20.3 | 20.4 | 20.6 | 20.4 | 20.4 |
| Resistance (Ω) | 0.0031613 | 0.0031485 | 0.0031520 | 0.0031255 | 0.0031395 | 0.0031375 | 0.0031420 |
| Resistance (Ω) (20° C.) | 0.0031569 | 0.0031441 | 0.0031487 | 0.0031212 | 0.0031330 | 0.0031332 | 0.0031376 |
| Diameter (mm) | 2.9327 | 2.9363 | 2.9356 | 2.9336 | 2.9353 | 2.9353 | 2.9339 |
| Diameter (inches) | 0.1155 | 0.1156 | 0.1156 | 0.1155 | 0.1156 | 0.1156 | 0.1155 |
| Area (mm$^2$) | 6.7551 | 6.7715 | 6.7683 | 6.7593 | 6.7671 | 6.7671 | 6.7604 |
| Area (cmil) | 13331.34 | 13363.64 | 13357.48 | 13339.75 | 13355.00 | 13355.01 | 13341.90 |
| Volume Resistivity at 20° C. (Ω * mm$^2$/m) | 0.0295569 | 0.0295085 | 0.0295379 | 0.0292406 | 0.0293848 | 0.0293864 | 0.0293779 |
| Volume Resistivity at 20° C. (Ω * cmil/ft) | 17.779 | 17.749 | 17.767 | 17.588 | 17.675 | 17.676 | 17.684 |
| Weight Resistivity at 20° C. (Ω * g/m$^2$) | 0.0798 | 0.0796 | 0.0797 | 0.0789 | 0.0793 | 0.0793 | 0.0793 |
| Weight Resistivity at 20° C. (Ω * lb/mile$^2$) | 455.678 | 454.932 | 455.386 | 450.801 | 453.025 | 453.050 | 453.254 |
| Volume Conductivity at 20° C. (% IACS) | 58.33 | 48.43 | 58.37 | 58.96 | 58.67 | 58.67 | 58.64 |
| Weight Conductivity at 20° C. (% IACS) | 192.07 | 192.39 | 192.19 | 194.15 | 193.20 | 193.19 | 193.10 |

| Sample | Diameter (inches) | Area (inches$^2$) | Yield Strength (offset = 0.2%) | Ultimate Tensile Strength | Valid Break? | Elongation in 10 in (%) |
|---|---|---|---|---|---|---|
| A (fully annealed) | 0.1150 | 0.01039 | 4.8 | 14.8 | Yes | 25.4 |
| B (fully annealed) | 0.1150 | 0.01039 | 5.0 | 14.7 | Yes | 28.8 |
| C (fully annealed) | 0.1150 | 0.01039 | 5.0 | 14.9 | Yes | 26.0 |
| 5 (fully annealed) | 0.1150 | 0.01039 | 4.6 | 14.5 | Yes | 26.8 |

Example 4—Analysis of Compositions

This example provides the results of the combustion/infrared analysis (ASTM E1099) and electrical conductivity measurements (ASTM E1004) of eight covetic aluminum alloy samples. The samples were made as described in the previous examples. The samples were extruded into a rod, then a wire, and drawn by the testing service, who performed the tests for which results are provided.

The samples of this example had the characteristics provided at the following table, which indicated the samples included either the Al composite material AlCv or Al 6005 as the base material.

| Sample No. | Base Material | Additive |
|---|---|---|
| 1 | AlCv (4%) | 0% graphene (baseline reference) |
| 2 | AlCv (4%) | 0.5% graphene |
| 3 | AlCv (4%) | 1.0% graphene |
| 4 | AlCv (4%) | 2.0% graphene |
| 5 | AlCv (4%) | 3.0% graphene |
| 6 | Al 6005 | 0% additive (baseline reference) |
| 7 | Al 6005 | 2% etched SiC blended with 1% etched alumina |
| 8 | Al 6005 | 3% etched SiC blended with 1.5% etched alumina |

The results of the combustion/infrared analysis (ASTM E1099) and electrical conductivity measurements (ASTM E1004) of the foregoing compositions are provided at the following table.

| Sample | Weight % | | Electrical Conductivity % |
|---|---|---|---|
| No. | Carbon | Sulfur | I.A.C.S. |
| 1 | — | — | 43.50 |
| 2 | — | — | 28.35 |
| 3 | — | — | 29.08 |

-continued

| Sample | Weight % | | Electrical Conductivity % |
|---|---|---|---|
| No. | Carbon | Sulfur | I.A.C.S. |
| 4 | — | — | 29.69 |
| 5 | — | — | 27.85 |
| 6 | 0.038 | 0.021 | 47.43 |
| 7 | 0.024 | 0.019 | 44.93 |
| 8 | 0.015 | 0.017 | 41.48 |

The carbon and sulfur contents of the foregoing table were the average values of two determinations on solid sections for each sample.

Example 5—Analysis of Rods, Wires, and Strips

In this example, Covetic rods, wires, and strips were manufactured with a 6000 series aluminum, and tested. The samples were made as described in the previous examples. The samples were extruded into a rod, then a wire, and drawn by the testing service, who performed the tests for which results are provided.

The rods, wires, and strips of this example were subjected to resistivity and conductivity tests (ASTM B193-02), the results of which are provided at the following tables.

| | Sample | | | | |
|---|---|---|---|---|---|
| Property | 1 | 2 | 3 | 4 | 5 |
| Weight (g) | 191.34 | 190.79 | 190.85 | 190.94 | 190.53 |
| Length (m) | 0.999 | 0.9985 | 1.001 | 0.997 | 0.996 |
| Temperature (° C.) | 19.9 | 20.1 | 20.2 | 20.3 | 20.4 |
| Resistance (Ω) | 0.0002931 | 0.0002945 | 0.0003479 | 0.0002949 | 0.0002949 |
| Resistance (Ω) (20° C.) | 0.0002932 | 0.0002943 | 0.0003476 | 0.0002945 | 0.0002944 |
| Diameter (mm) | 9.4949 | 9.4836 | 9.4733 | 9.4945 | 9.4891 |
| Diameter (inches) | 0.338 | 0.3734 | 0.3730 | 0.3738 | 0.3736 |
| Area ($mm^2$) | 70.8065 | 70.6383 | 70.4840 | 70.8002 | 70.7191 |
| Area (cmil) | 139738.4 | 139406.5 | 139102.0 | 139725.9 | 139565.9 |
| Volume Resistivity at 20° C. (Ω*$mm^2$/m) | 0.0276776 | 0.0277224 | 0.0326689 | 0.0278050 | 0.0277620 |
| Volume Resistivity at 20° C. (Ω*cmil/ft) | 16.649 | 16.676 | 19.651 | 16.725 | 16.699 |
| Weight Resistivity at 20° C. (Ω*g/$m^2$) | 0.074868 | 0.074989 | 0.088369 | 0.075212 | 0.075096 |
| Weight Resistivity at 20° C. (Ω*lb/$mile^2$) | 427.4959 | 428.1872 | 504.5886 | 429.4639 | 428.7996 |
| Volume Conductivity at 20° C. (% IACS) | 62.29 | 62.19 | 52.78 | 62.01 | 62.10 |
| Weight Conductivity at 20° C. (% IACS) | 204.73 | 204.40 | 173.45 | 203.80 | 204.11 |

*The base 6000 series aluminum had an IACS of 29.

| Property | Sample 1 (as swaged) | 2 (as swaged) | 3 (as swaged) | 4 (as swaged) | 5 (as swaged) |
|---|---|---|---|---|---|
| Weight (g) | 86.91 | 82.93 | 86.11 | 83.17 | 83.89 |
| Length (m) | 1.345 | 1.357 | 1.356 | 1.333 | 1.329 |
| Temperature (° C.) | 18.6 | 19.1 | 19.6 | 20.1 | 20.4 |
| Resistance (Ω) | 0.0008871 | 0.0009222 | 0.0010725 | 0.0009127 | 0.0009021 |
| Resistance (Ω) (20° C.) | 0.0008922 | 0.0009255 | 0.0010742 | 0.0009124 | 0.0009006 |
| Diameter (mm) | 5.5150 | 5.3634 | 5.4672 | 5.4193 | 5.4508 |
| Diameter (inches) | 0.2171 | 0.2112 | 0.2152 | 0.2134 | 0.2146 |
| Area ($mm^2$) | 23.8880 | 22.5925 | 23.4761 | 23.0658 | 23.3355 |
| Area (cmil) | 47143.6150 | 44586.895 | 46330.749 | 45521.018 | 46053.287 |
| Volume Resistivity at 20° C. (Ω*$mm^2$/m) | 0.0284164 | 0.0278800 | 0.0336251 | 0.0280589 | 0.0280213 |
| Volume Resistivity at 20° C. (Ω*cmil/ft) | 17.093 | 16.770 | 20.226 | 16.878 | 16.855 |
| Weight Resistivity at 20° C. (Ω*g/$m^2$) | 0.07686 | 0.075415 | 0.090955 | 0.075899 | 0.075797 |
| Weight Resistivity at 20° C. (Ω*lb/$mile^2$) | 438.906 | 430.621 | 519.358 | 433.385 | 432.804 |
| Volume Conductivity at 20° C. (% IACS) | 60.67 | 61.84 | 51.27 | 61.45 | 61.53 |
| Weight Conductivity at 20° C. (% IACS) | 199.41 | 203.25 | 168.52 | 201.95 | 202.22 |

| Property | Sample 1 (as drawn, 0.132") | 2 (as drawn, 0.132") | 3 (as drawn, 0.132") | 4 (as drawn, 0.132") | 5 (as drawn, 0.132") |
|---|---|---|---|---|---|
| Weight (g) | 24.07 | 23.99 | — | 24.21 | 24.03 |
| Length (m) | 1.001776 | 1.001522 | — | 1.00584 | 1.00252 |
| Temperature (° C.) | 16.9 | 17 | — | 17 | 17 |
| Resistance (Ω) | 0.0023258 | 0.0023405 | — | 0.0023312 | 0.0023323 |
| Resistance (Ω) (20° C.) | 0.0023552 | 0.0023691 | — | 0.0023597 | 0.0023608 |
| Diameter (mm) | 3.3630 | 3.3578 | — | 3.3659 | 3.3589 |
| Diameter (inches) | 0.1324 | 0.1322 | — | 0.1325 | 0.1322 |
| Area ($mm^2$) | 8.8826 | 8.8553 | — | 8.8981 | 8.8612 |
| Area (cmil) | 17529.96 | 17476.126 | — | 17560.679 | 17487.839 |
| Volume Resistivity at 20° C. (Ω*$mm^2$/m) | 0.0278939 | 0.0279726 | — | 0.0279962 | 0.0278927 |
| Volume Resistivity at 20° C. (Ω*cmil/ft) | 16.7787 | 16.8261 | — | 16.8403 | 16.7779 |
| Weight Resistivity at 20° C. (Ω*g/$m^2$) | 0.07545 | 0.075666 | — | 0.075729 | 0.075449 |

-continued

| Property | Sample 1 (as drawn, 0.132") | 2 (as drawn, 0.132") | 3 (as drawn, 0.132") | 4 (as drawn, 0.132") | 5 (as drawn, 0.132") |
|---|---|---|---|---|---|
| Weight Resistivity at 20° C. (Ω*lb/mile$^2$) | 430.8365 | 432.0518 | — | 432.4171 | 430.8174 |
| Volume Conductivity at 20° C. (% IACS) | 61.81 | 61.64 | — | 61.58 | 61.81 |
| Weight Conductivity at 20° C. (% IACS) | 203.15 | 202.57 | — | 202.40 | 203.16 |

The samples of this example had a density of about 2.705 g/cm$^3$.

The tensile properties (10" gage length) of the foregoing samples also were tested, and the results of these tests are provided at the following table:

| Sample | Diameter (inches) | Area (inches$^2$) | Yield Strength (offset = 0.2%) | Ultimate Tensile Strength (ksi) | Valid Break? | Elongation in 10 in. (%) |
|---|---|---|---|---|---|---|
| 1 | 0.3750 | 0.11045 | 8.6 | 15.5 | Yes | 14.0 |
| 2 | 0.3750 | 0.11045 | 9.8 | 18.5 | Yes | 3.0 |
| 3 | 0.3750 | 0.11045 | 8.6 | 14.7 | Yes | 4.6 |
| 4 | 0.3750 | 0.11045 | 9.5 | 17.0 | Yes | 4.0 |
| 5 | 0.3750 | 0.11045 | 10.4 | 18.5 | Yes | 3.0 |
| 1 (as swaged) | 0.2200 | 0.03801 | 14.0 | 15.0 | Yes | 2.0 |
| 2 (as swaged) | 0.2200 | 0.03801 | 17.2 | 18.1 | No | 0.0 |
| 3 (as swaged) | 0.2200 | 0.03801 | 15.8 | 18.3 | No | 0.0 |
| 4 (as swaged) | 0.2200 | 0.03801 | 16.4 | 18.5 | No | 0.0 |
| 5 (as swaged) | 0.2200 | 0.03801 | 16.3 | 18.3 | Yes | 1.6 |
| 1 (as drawn, 0.132") | 0.1320 | 0.01368 | 12.7 | 22.2 | Yes | 1.4 |
| 2 (as drawn, 0.132") | 0.1320 | 0.01368 | 15.7 | 23.7 | No | 0.0 |
| 3 (as drawn, 0.132") | 0.1320 | 0.01368 | 20.3 | 24.9 | No | 0.0 |
| 4 (as drawn, 0.132") | 0.1320 | 0.01368 | 17.8 | 24.2 | No | 0.0 |

The invention claimed is:

1. A method for continuously producing a composite material, the method comprising:

providing a reservoir comprising a first feed a second feed, a third feed, a fourth feed, and a mixer;

disposing a liquid metal and a carbon material in the reservoir continuously via the first feed and the second feed, respectively;

mixing the liquid metal and the carbon material in a first portion of the reservoir to form a mixture;

transporting the mixture from the first portion of the reservoir to a second portion of the reservoir, wherein the second portion of the reservoir is adjacent the first portion of the reservoir;

applying an electrical charge to the mixture in the second portion of the reservoir to form the composite material, wherein the applying of the electrical charge to the mixture comprises passing the mixture through a void defined by a device that is (i) disposed in the second portion of the reservoir, and (ii) provided a first charge by the fourth feed; and collecting the composite material;

wherein the mixer traverses at least a portion of the void, and the third feed provides a second charge to the mixer, wherein the first charge and the second charge are opposite charges.

2. The method of claim 1, wherein a temperature inside the reservoir exceeds the melting point of the composite material.

3. The method of claim 1, wherein the mixing of the liquid metal and the carbon material comprises contacting the liquid metal and the carbon material with the mixer.

4. The method of claim 3, wherein the mixer (i) is arranged in the first portion of the reservoir and the second portion of the reservoir, and (ii) comprises a rotating auger.

5. The method of claim 1, wherein the transporting of the mixture from the first portion of the reservoir to the second portion of the reservoir is achieved by gravity, a force applied to the mixture by the mixer, or a combination thereof.

6. The method of claim 1, wherein the void is circular.

7. The method of claim 1, wherein the reservoir further comprises a fifth feed, and the method further comprises disposing an inert gas in the reservoir via the fifth feed.

8. The method of claim 1, wherein the collecting of the composite material comprises transporting the composite material from the second portion of the reservoir to a holding tank.

9. The method of claim 8, wherein the transporting of the composite material from the second portion of the reservoir to the holding tank is achieved by gravity.

10. The method of claim 8, wherein an inert gas is disposed in the holding tank, and a temperature inside the holding tank exceeds the melting point of the composite material.

11. The method of claim 8, wherein a control valve is arranged between the second portion of the reservoir and the holding tank, and the method further comprises removing a sample of the composite material through the control valve.

12. The method of claim 1, wherein the reservoir further comprises a sixth feed, and the method further comprises disposing one or more additives in the reservoir via the sixth feed.

13. A method for continuously producing a composite material, the method comprising:

providing a reservoir comprising a first feed and a second feed;

disposing a liquid metal and a carbon material in the reservoir continuously via the first feed and the second feed, respectively;

mixing the liquid metal and the carbon material in a first portion of the reservoir to form a mixture;

transporting the mixture from the first portion of the reservoir to a second portion of the reservoir, wherein the second portion of the reservoir is adjacent the first portion of the reservoir;

applying an electrical charge to the mixture in the second portion of the reservoir to form the composite material;

removing a sample of the composite material through a control valve, wherein the control valve is arranged between the second portion of the reservoir and a holding tank; and collecting the composite material, wherein the collecting of the composite material comprises transporting the composite material from the second portion of the reservoir to the holding tank.

14. The method of claim 13, wherein a temperature inside the reservoir and a temperature inside the holding tank exceed the melting point of the composite material.

15. The method of claim 13, wherein (i) the mixing of the liquid metal and the carbon material comprises contacting the liquid metal and the carbon material with a mixer, (ii) the mixer is arranged in the first portion of the reservoir and the second portion of the reservoir, and (iii) the mixer comprises a rotating auger.

16. The method of claim 13, wherein the transporting of the mixture from the first portion of the reservoir to the second portion of the reservoir is achieved by gravity, a force applied to the mixture by a mixer, or a combination thereof.

17. The method of claim 13, wherein the reservoir comprises a third feed, and the applying of the electrical charge to the mixture comprises passing the mixture through a void defined by a device that is (i) disposed in the second portion of the reservoir, and (ii) provided a first charge by the third feed.

18. The method of claim 17, wherein the void is circular.

19. The method of claim 17, wherein the reservoir further comprises (i) a mixer that traverses at least a portion of the void, and (ii) a fourth feed that provides a second charge to the mixer, wherein the first charge and the second charge are opposite charges.

20. The method of claim 13, wherein the reservoir further comprises a fifth feed, and the method further comprises disposing one or more additives in the reservoir via the fifth feed.

* * * * *